United States Patent [19]

Argintaru et al.

[11] Patent Number: 4,819,004

[45] Date of Patent: Apr. 4, 1989

[54] PRINTED CIRCUIT ARRAY ANTENNA

[75] Inventors: Lazare Argintaru, Le Pre Saint Gervais; Eric Leroux, Levallois Perret, both of France

[73] Assignee: Alcatel Thomason Faisceaux Hertziens, Levallois Perret, France

[21] Appl. No.: 29,919

[22] Filed: Mar. 26, 1987

[30] Foreign Application Priority Data

Mar. 26, 1986 [FR] France ..... 86 04392

[51] Int. Cl.[4] ..... H01Q 13/02

[52] U.S. Cl. ..... 343/778; 343/786; 343/789

[58] Field of Search ... 343/778, 786, 776, 700 MS File, 343/795, 797, 789, 846, 829, 872, 878

[56] References Cited

U.S. PATENT DOCUMENTS

| | | | |
|---|---|---|---|
| 3,747,114 | 7/1973 | Shyhalla | 343/795 |
| 4,208,660 | 6/1980 | McOwen, Jr. | 343/769 |
| 4,369,447 | 1/1983 | Edney | 343/700 MS |
| 4,486,758 | 12/1984 | de Ronde | 343/700 MS |
| 4,614,947 | 9/1986 | Rammos | 343/786 |
| 4,622,559 | 11/1986 | Shafai et al. | 343/786 |
| 4,644,362 | 2/2987 | Rammos | 343/786 |

FOREIGN PATENT DOCUMENTS

| | | |
|---|---|---|
| 0089084 | 9/1983 | European Pat. Off. . |
| 0108463 | 5/1984 | European Pat. Off. . |

OTHER PUBLICATIONS

Electronics Letters, vol. 18, No. 6, Mar. 18, 1982, pp. 252-253, London, GB, E. Rammos.

*Primary Examiner*—William L. Sikes
*Assistant Examiner*—Michael C. Wimer
*Attorney, Agent, or Firm*—Sughrue, Mion, Zinn, Macpeak & Seas

[57] ABSTRACT

A printed circuit array antenna includes at least one printed circuit formed by a substrate having radiating elements on a first face and an energy distribution tree on a second face. The array antenna is provided with a front structure having an elongated shape and superposed on the first face of the printed circuit. The front structure is composed of a substrate pierced with radiating apertures located opposite to the radiating elements of the printed circuit.

7 Claims, 3 Drawing Sheets

PRINTED CIRCUIT ARRAY ANTENNA

BACKGROUND OF THE INVENTION

1. Field of the Invention

The present invention relates to a novel array antenna constructed in accordance with printed circuit technology.

2. Description of the Prior Art

A printed circuit array antenna has the general appearance of a plate formed by one or a number of superposed printed circuits, one face of one of said printed circuits being provided with radiating dipoles and the other face being provided with an energy distribution tree.

These printed circuit plates have a surface area which is substantially equivalent to parabolic antennas with equivalent gain and must be rigidly supported by a rear structure.

The support structure just mentioned serves to guard against angular deviations and deformations caused by wind and gravitation force but makes it necessary to provide an interface with the printed circuit.

The present invention is intended to lighten or even to dispense with said rear support structure by making use of a front plate with radiating apertures in order to endow the antenna with enhanced strength and rigidity.

SUMMARY OF THE INVENTION

The invention accordingly proposes a printed circuit array antenna of elongated shape including at least one printed circuit, this first printed circuit being constituted by a substrate on which radiating elements are disposed on a first face, an energy distribution tree disposed on a second face, and a front structure of elongated shape superposed on the first face of said printed circuit. The front structure aforesaid is constituted by a substrate pierced with radiating apertures located opposite to the radiating elements of said printed circuit. The distinctive feature of the array antenna lies in the fact that the substrate which constitutes the front structure is at least metallized at the surface thereof and that traps formed by grooves of annular shape are disposed around the external ends of the apertures pierced in the front structure.

As an advantageous feature, the invention provides a second circuit having a first face superposed on the second face of the first printed circuit, a ground plane being placed on the second face of said second printed circuit.

The solution proposed makes it possible to limit the coupling between radiating elements, which is a disadvantage encountered in conventional array antennas. Furthermore, this structure makes it possible to place traps around the apertures.

Moreover, the front structure has the advantage of protecting the antenna against mechanical impacts (projectiles, transportation and so on) and permits stretching of a flexible radome without any difficulty.

It should be noted in addition that there is no longer any problem in regard to mechanical positioning of constituent elements with respect to each other. This novel type of antenna can accordingly be made to assume any desired configuration and may thus be readily integrated with a pre-existing structure.

DESCRIPTION OF THE PREFERRED EMBODIMENTS

Figure 1:
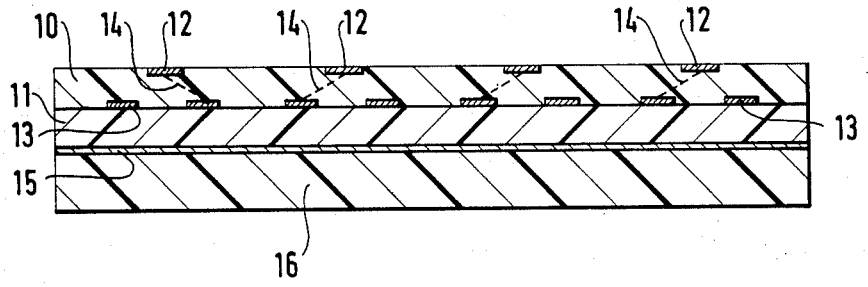
FIG.1 PRIOR ART
FIG. 1 illustrates an array antenna of the prior art.

The array antenna of the prior art as illustrated in FIG. 1 is designed in the form of a plate consisting of a first printed circuit 10 superposed on a second printed circuit 11. The first circuit 10 has radiating dipoles 12 on one face of a substrate and has an energy distribution tree 13 formed of interconnected conductors on the other face for the purpose of supplying the dipoles via feedthrough lines 14 in order to permit emission of radio-frequency electromagnetic radiation by said dipoles 12. A ground plane 15 is provided on the external face of the second printed circuit 11.

The dimensions of the radiating dipoles 12, of the energy distribution tree 13 and of the ground plane 15 have been deliberately increased for the sake of enhanced clarity of the drawings but these components in fact consist simply of metal deposits.

In order to make up for the fragility of the assembly thus formed, the antenna is provided with a rear support structure 16 for increased strength and rigidity.

Figure 2:
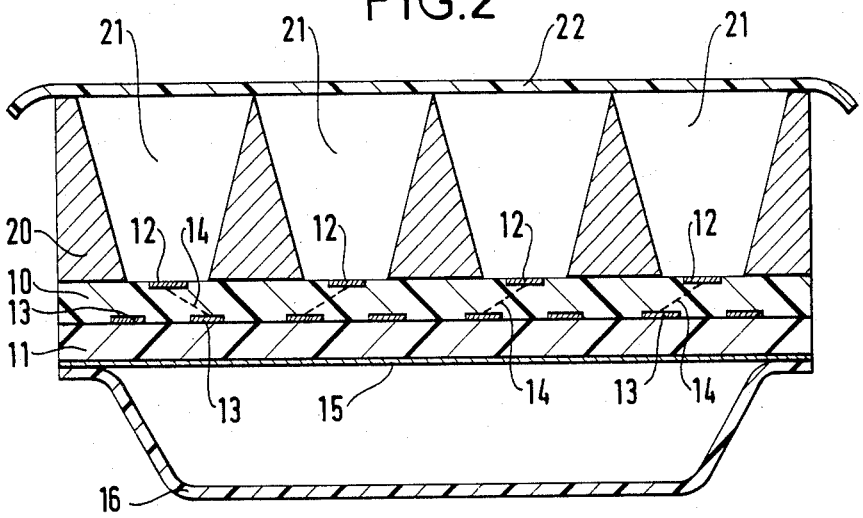
FIG. 2 illustrates an array antenna in accordance with the invention.

The array antenna in accordance with the invention as illustrated in FIG. 2 is also provided with two printed circuits 10, 11 as described earlier but the rear support structure 16 is much lighter. This antenna is provided in addition with a front structure 20 consisting of a metal plate pierced by apertures 21 of conical shape and superposed on the substrate of the first face of the first printed circuit 10. Each aperture 21 is oriented in a direction at right angles to the surface of said first printed circuit 10 and located opposite to a radiating element 12.

In FIG. 2, there is shown a radome 22 which serves to protect the antenna under bad weather conditions.

Figure 3:
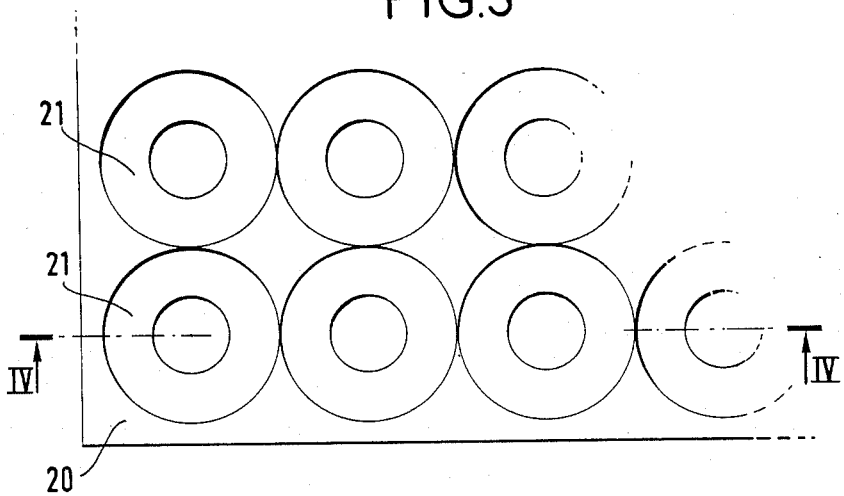
FIGS. 3 and 4 illustrate a top view and a sectional view taken along the plane IV—IV of a front structure in accordance with the invention.
Figure 4:
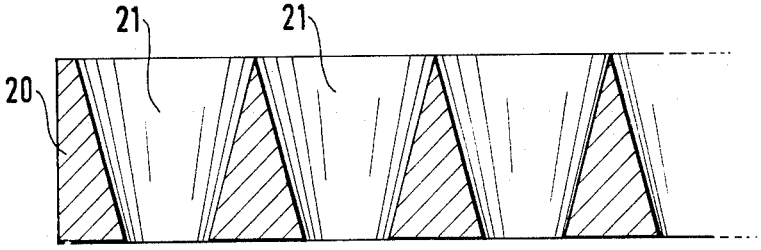

As shown in a front view in FIG. 3 and in cross-section in FIG. 4, the front structure 20 has the function of strengthening the antenna and serves to vary the antenna radiation pattern by utilizing different aperture directions.

Figure 5:
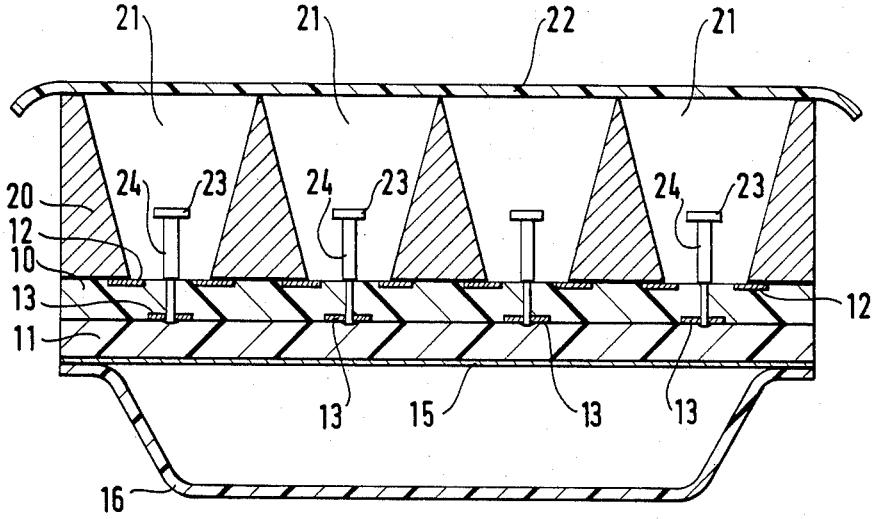
FIG. 5 illustrates a first alternative embodiment of an array antenna in accordance with the invention.

FIG. 5 illustrates an alternative embodiment of the invention in which the radiating elements consist of a conductive button 23 mounted on the end of a small conductive rod 24, projecting through the printed circuit substrate and the conductors, respectively of the energy distribution tree 13 on the other face of the first printed circuit 10 thus making it possible to modify the radiation pattern of this antenna. The rod 24 projects well into the conical aperture 21 of the front structure 20.

Figure 6:
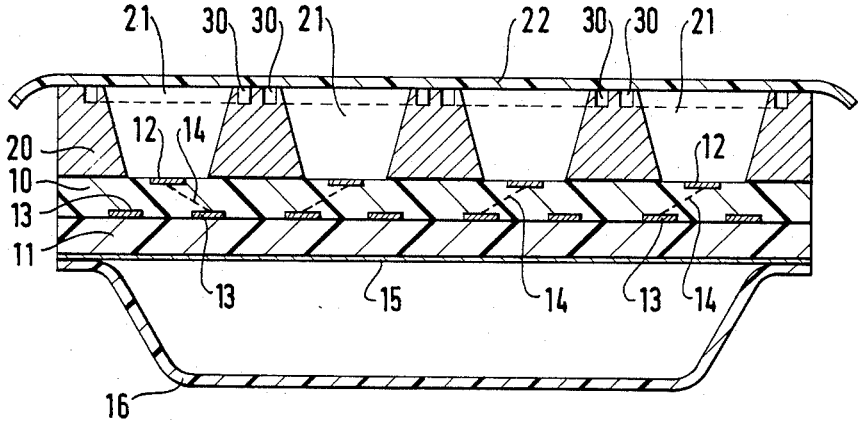
FIG. 6 illustrates a second alternative embodiment of an array antenna in accordance with the invention.

FIG. 6 shows an antenna having a structure which is similar to that of FIG. 2. In the metal plate which forms the front structure 20, annular grooves 30 are cut around the outer ends of the apertures 21 in order to form choke ring traps which serve to render the radiation pattern each aperture symmetrical.

The antenna in accordance with the invention can be employed for example at frequencies ranging from 1 GHz to more than 20 GHz. As the frequency is of higher value, so the radiating elements are more closely spced and the front structure is of smaller thickness.

It will be readily apparent that the present invention has been described in the foregoing with reference to the accompanying drawings solely by way of preferential example and that its constituent elements could be replaced by equivalent elements without thereby departing either from the scope or the spirit of the invention.

From this it accordingly follows that the front structure 20 can consist, for example, of a substrate of plastic material having metallized surfaces.

It also follows that the rear structure 16 is no longer essential since the antenna can be fixed by means of the front structure 20.

In accordance with a further alternative arrangement as shown in FIG. 2, the radiating elements can consist of radiating dipoles 12 connected to the energy distribution tree 13 by means of the printed circuit. However, consideration could be given to a number of different alternative designs. Thus said radiating elements could also consist, for example, of small antennas connected to the energy distribution tree by means of the printed circuit.

The radiating apertures 21 are not limited to a conical shape but may have cylindrical or other shapes, the dimensions of which will be a function of the desired gain and frequency. The axis of each aperture can be oriented at will with respect to the direction at right angles to the plate which supports the radiating elements in order to shape the antenna lobe at will. These apertures can be arranged with respect to each other in a manner which is different from that shown in FIG. 3. Their positions are in fact dependent on the positions of the radiating elements on the first printed circuit.

The antenna in accordance with the invention is illustrated in the form of a plate but may also have any desired shape such as cylindrical or conical and can even have a variable thickness which permits adaptation of the antenna to any existing structure.

What is claimed is:

1. A printed circuit array antenna of elongated shape including at least a first printed circuit, said first printed circuit being constituted by a substrate having opposite first and second faces, radiating elements disposed on said first face, an energy distribution tree of interconnected conductors diposed on said second face, and a front structure of elongated planar shape superposed on the first face of said first printed circuit, said front structure being constituted by a rigid plate substrate having front and rear surfaces, pierced with spaced, axially elongated, radiating apertures orthogonal to the plane of the rear surface and located coaxially about the radiating elements of said first printed circuit, wherein the front structure substrate is at least metallized over the external surfaces thereof and wherein choke ring traps formed by grooves of annular shape are provided within the front surface of the front structure remote from the first printed circuit and disposed around the ends of the apertures of said front structure.

2. An array antenna according to claim 1, wherein said second printed circuit has opposite first and second faces, said first face of a second printed circuit is superposed on the second face of the first printed circuit, and a ground plane is placed on the second face of said second printed circuit.

3. An array antenna according to claim 2, wherein said antenna further includes a unitary light weight rear support structure spanning completely across the second face of said second printed circuit.

4. An array antenna according to claim 1, wherein the substrate which constitutes the front structure is of metal.

5. An array antenna according to claim 1, wherein the front structure is pierced with openings of conical shape.

6. An array antenna according to claim 1, wherein each radiating element is constituted by a conductive button mounted on an end of a small conductive rod projecting through the first printed circuit substrate into a respective aperture, and said conductive rod has its other end in contact with said energy distribution tree.

7. An array antenna according to claim 1, wherein the axis of each radiating aperture is oriented with respect to the direction at right angles to the first printed circuit substrate which supports the radiating elements in order to shape the lobe of said antenna radiation beam pattern at each radiating aperture.

* * * * *